US009809967B1

(12) United States Patent
Conrad

(10) Patent No.: US 9,809,967 B1
(45) Date of Patent: Nov. 7, 2017

(54) TOILET WITH ENHANCED CLEANING FEATURES

(71) Applicant: Mansfield Plumbing Products, LLC, Perrysville, OH (US)

(72) Inventor: Paul Conrad, Ashland, OH (US)

(73) Assignee: Mansfield Plumbing Products, LLC, Perrysville, OH (US)

( * ) Notice: Subject to any disclaimer, the term of this patent is extended or adjusted under 35 U.S.C. 154(b) by 0 days.

(21) Appl. No.: 15/221,744

(22) Filed: Jul. 28, 2016

(51) Int. Cl.
*E03D 11/00* (2006.01)
*E03D 11/02* (2006.01)
*A47K 13/24* (2006.01)

(52) U.S. Cl.
CPC ..... *E03D 11/02* (2013.01); *A47K 13/24* (2013.01)

(58) Field of Classification Search
CPC ..... E03D 11/02
USPC ..... 4/420–420.5, 234–242.1
See application file for complete search history.

(56) References Cited

U.S. PATENT DOCUMENTS 3,504,385 A * 4/1970 Fields ..... A47K 13/10 4/246.5
3,969,778 A * 7/1976 Richards ..... A47K 17/026 4/254
4,507,813 A * 4/1985 Lawson ..... A47K 13/242 292/210
4,639,147 A * 1/1987 Schwarz ..... A47K 13/12 114/144 R
4,715,069 A * 12/1987 James ..... A47K 17/026 4/254
5,983,410 A * 11/1999 Webster ..... A47K 17/00 4/300.3
6,453,478 B1 * 9/2002 Semmler ..... A47K 13/26 4/236
2004/0045082 A1 * 3/2004 Marras ..... A47K 13/10 4/246.1
2004/0231037 A1 * 11/2004 Erves ..... E03D 9/00 4/300.3
2008/0161172 A1 * 7/2008 Marcantonio ..... A47K 17/026 482/129
2010/0125935 A1 * 5/2010 Leibfried ..... A47K 13/26 4/240
2015/0359392 A1 * 12/2015 Richmond ..... A47K 13/02 4/237
2017/0130437 A1 * 5/2017 Grover ..... E03D 9/031

* cited by examiner

*Primary Examiner* — Lori Baker
(74) *Attorney, Agent, or Firm* — Renner Kenner Greive Bobak Taylor & Weber

(57) ABSTRACT

A toilet having enhanced cleaning features includes a drain surface positioned behind a rear edge of a toilet bowl opening, which is sloped to direct the flow of liquid waste captured therein back into the toilet bowl. The toilet may also include a seat and lid having arms that are pivotably attached to the toilet, which are spaced so that they are laterally positioned to the outside of at least a portion of a deck surface when the seat and lid are resting thereupon. Additionally, the toilet seat and lid may pivot about an axis that is positioned behind the bowl opening and a proximate to a flushwater inlet of the toilet. Thus, such features of the toilet allow the seat and lid to be positioned so that the deck surface, as well as the drain surface, can be readily accessed and cleaned.

24 Claims, 12 Drawing Sheets

TOILET WITH ENHANCED CLEANING FEATURES

TECHNICAL FIELD

The present invention is directed to toilets. Particularly, the present invention is directed to a toilet having a toilet seat and lid with a pivot axis that is positioned proximate to a flushwater inlet. More particularly, the present invention is directed to a toilet seat and lid that each include attachment arms that are positioned outside the lateralmost edges of a portion of a deck surface of the toilet bowl when the seat and lid are resting thereupon.

BACKGROUND OF THE INVENTION

A conventional toilet 10, as shown in FIG. 1, includes a toilet base 12 to which a flushwater tank 14 is fluidly attached. The toilet base 12 is typically formed from a material, such as ceramic or porcelain, which is conducive to being easily cleaned and sanitized. Disposed in the toilet base 12 in front of the tank 14 is a toilet bowl 16 and associated toilet bowl opening 18. As such, during operation of the toilet 10, flushwater is released into the toilet bowl 16 to evacuate liquid and solid waste out of the bowl 16, and through a primary outlet (not shown) located in the bottom of the bowl 16 for delivery to a suitable sewage system.

The upper surface of the toilet base 12 comprises a substantially flat upper deck surface 20, which extends from a front end 22 to a rear end 24 of the toilet base 12. As such, the deck surface 20 surrounds the toilet bowl opening 18. Thus, in conventional toilets, such as toilet 10, the upper deck surface 20 serves as a point of attachment for a toilet seat 30, a toilet lid 32 and for the flushwater tank 14. In particular, the toilet seat and lid 30,32 are pivotably attached by one or more hinges 34 to an intermediate portion 36 of the deck surface 20 that is located between a rear edge 37 of the toilet bowl opening 18 proximate to the rear end 24 of the toilet base 12 and a front surface 39 of the tank 14 that is proximate to the front end 22 of the toilet base 12. As such, the seat 30 and the lid 32 may be selectively pivoted so that they are brought to rest upon the deck surface 20 of the toilet base 12, or may be raised upward away from the toilet bowl opening 18, so as to be positioned proximate or adjacent to the front surface 39 of the tank 14, as shown in FIG. 1, as needed.

However, because the intermediate deck surface 36 is flat, and is adjacent to the rear edge 37 of the toilet bowl opening 18, the intermediate deck surface 36 is subject to the accumulation of liquid waste, or urine, as well as other debris over the course of time as the toilet 10 is used. This causes the toilet 10 to have an unpleasant appearance, as well as taking on an unsanitary condition, which is undesirable. Unfortunately, the intermediate portion 36 that is susceptible to accumulation of waste and debris is obscured by the toilet seat and lid 30,32, as well as by the hinges 34, base 12. This interferes with the ability of individuals charged with cleaning and sanitizing the toilet 10 to easily access the intermediate deck portion 36 of the deck surface 20, as such individuals must undertake the tedious and cumbersome task of navigating around the hinges 34 with a cleaning towel or other cleaning tool.

Because of the difficulty in cleaning around the hinges 34, the intermediate deck portion 36 is typically not cleaned effectively. In addition, because the seat and the lid 30,32 are typically attached directly to the hinges 34, the rear edges 40,42 of the seat and lid 30,32 that are proximate to the rear edge 37 of the bowl opening 18 are placed in close proximity with the intermediate portion 36 of the deck surface 20. The close proximity of the rear edges 40,42 of the seat and lid 30,32 to the intermediate portion 36 also makes it difficult for individuals to insert cleaning tools, such as cleaning towels, in an area 43 that is between the rear edges 40,42 of the seat and the lid 30,32 and the intermediate deck portion 36. Furthermore, because the seat and lid 30,32 are typically rested against the flushwater tank 14 in a substantially vertical position when the toilet 10 is being cleaned, as shown in FIG. 1, only a small amount of room or area is provided between the hinges 34, the front surface 39 of the tank 14, and the top of the lid 32 to accommodate cleaning tools for cleaning the section of the intermediate portion 36 that is between the hinges 34 and between the rear edge 37 of the bowl opening 18 the front surface 39 of tank 14 and the rear edge. Thus, the position of the hinges 34 and the close proximity of the seat and lid 30,32 to the intermediate deck portion 36 in this region creates physical obstacles that prevents the effective cleaning and sanitization of the intermediate deck portion 36 of the flat deck surface 20.

In addition, there is a need for a toilet that has a backsplash that is positioned in the intermediate portion of the deck surface, whereby the backsplash is sloped downward into the toilet bowl opening to allow urine or other liquid captured by the backsplash to drain into the toilet bowl opening. Therefore, there is a need for a toilet that has a seat and lid that each include elongated attachment arms that are positioned outside or beyond the lateralmost edges of an intermediate portion of an upper deck surface of the toilet that is positioned between a rear edge of the toilet bowl opening and a front surface of a flushwater tank, so that the intermediate deck portion is left fully exposed and unobstructed when the toilet seat and lid are raised away from the deck surface for cleaning. Still yet, there is a need for a toilet that has a seat and lid that are pivotably attached to a toilet base, such that toilet seat and lid pivot on an axis that is positioned proximate to a flushwater inlet. There is also a need for a toilet that includes an attachment member that is pivotably attached to a toilet base and that pivots about a substantially vertical axis, such that an accessory, such as a toilet seat and toilet lid attached thereto may be laterally rotated to the side of the toilet to facilitate the cleaning of the toilet base.

SUMMARY OF THE INVENTION

In light of the foregoing, it is a first aspect of the present invention to provide a toilet that includes a base having an opening that extends into a bowl, wherein the base includes a deck surface that extends outward from an edge of the opening; a flushwater inlet disposed in the deck surface, which is adapted to receive flushwater therein for delivery to the bowl; and an accessory adapted to be pivotably attached to the base, the accessory pivoting on an axis that is proximate to the flushwater inlet.

It is another aspect of the present invention to provide a toilet that includes a base having an opening that extends into a bowl, wherein the base includes a deck surface that extends outward from an edge of the opening; a flushwater inlet disposed in the deck surface, which is adapted to receive flushwater therein for delivery to the bowl; and an accessory having at least one elongated arm that extends therefrom that is adapted to be pivotably attached to the base, such that when the accessory is moved to be proximate to the deck surface, the at least one arm is positioned laterally, and to the outside, of at least a portion of the deck surface that is positioned between the opening of the bowl and the flushwater inlet.

It is still another aspect of the present invention to provide a toilet that includes a base having an opening that extends into a bowl, wherein the base includes a deck surface that extends outward from an edge of the opening; a flushwater inlet disposed in the deck surface, which is adapted to receive flushwater therein for delivery to the bowl; and an attachment member pivotably attached to the base, the attachment member pivoting about a substantially vertical axis, wherein the attachment member is adapted to be attached to an accessory.

It is another aspect of the present invention to provide a toilet having a base having an opening that extends into a bowl, wherein the base includes a deck surface that extends outward from an edge of the opening; and a flushwater inlet disposed in the deck surface, which is adapted to receive flushwater therein for delivery to the bowl, wherein at least a portion of the deck surface that is positioned between the opening of the bowl and the flushwater inlet includes a drain surface that is sloped downward toward the edge of the opening of the bowl.

BRIEF DESCRIPTION OF THE DRAWINGS

These and other features and advantages of the present invention will become better understood with regard to the following description, appended claims, and accompanying drawings wherein:

DETAILED DESCRIPTION OF THE INVENTION

Figure 1:
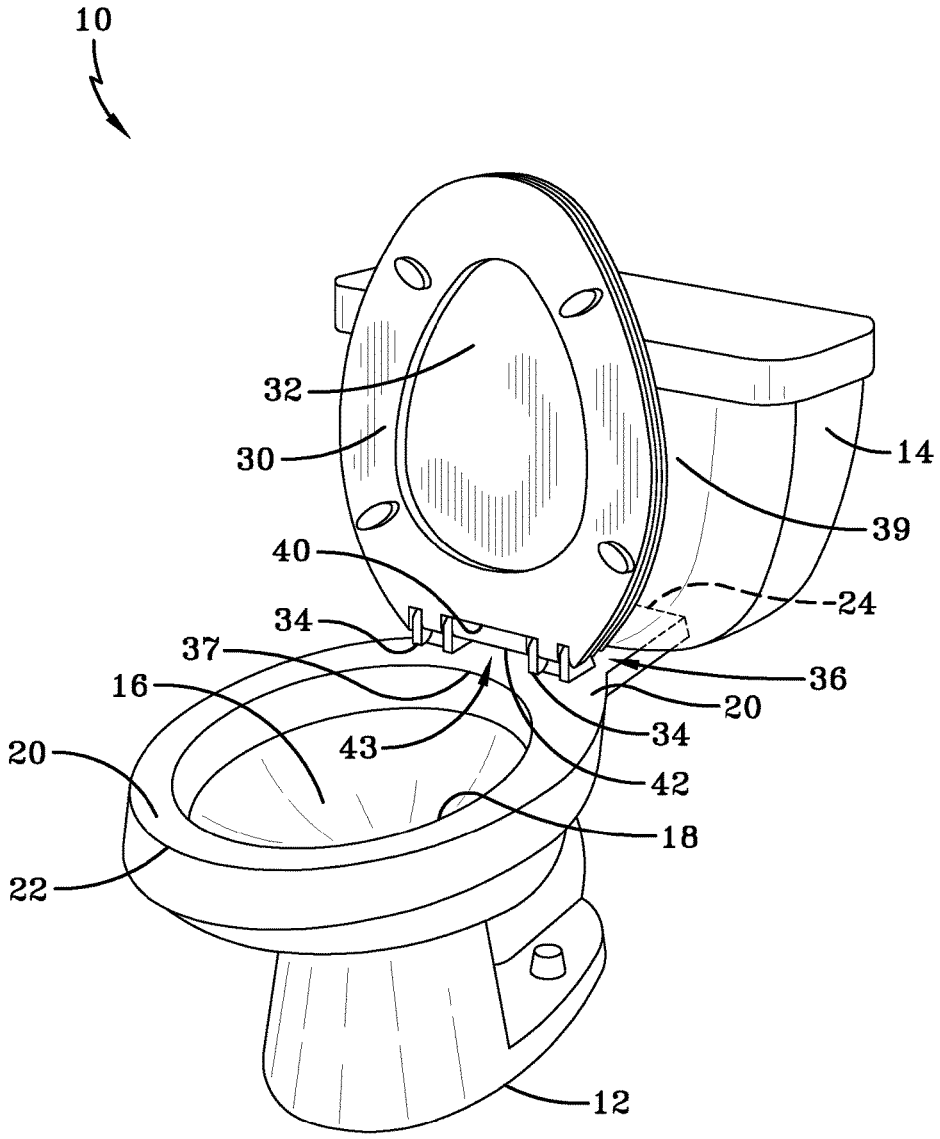
FIG. 1 Prior Art
FIG. 1 is a perspective view of a prior art toilet having a seat and lid that are attached to an intermediate portion of an upper deck surface of a toilet base by hinges.
Figure 2A:
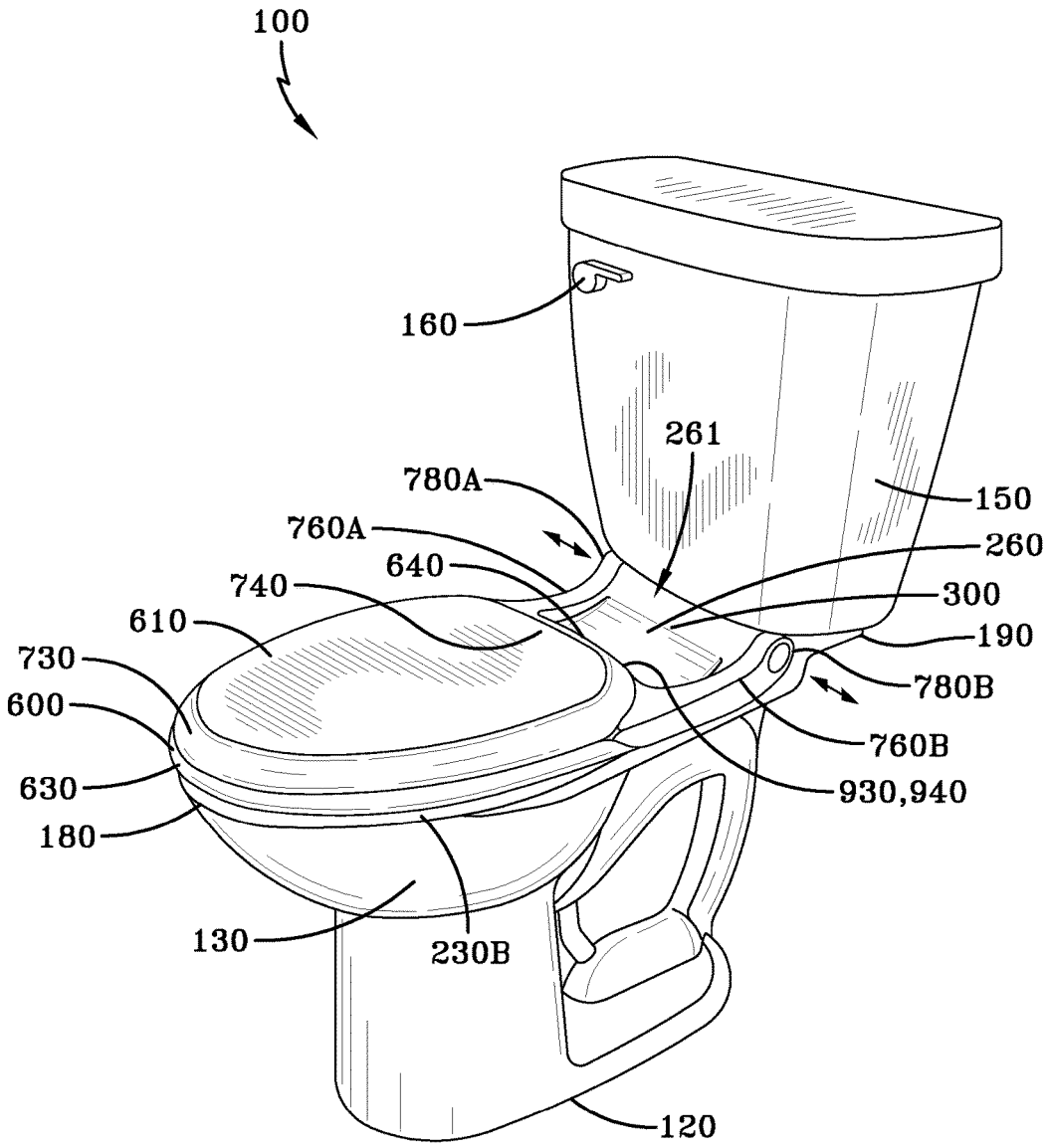
FIG. 2A is a perspective view of a toilet that includes a drain surface, whereby the toilet lid is in a closed position in accordance with the concepts of the present invention.
Figure 2B:
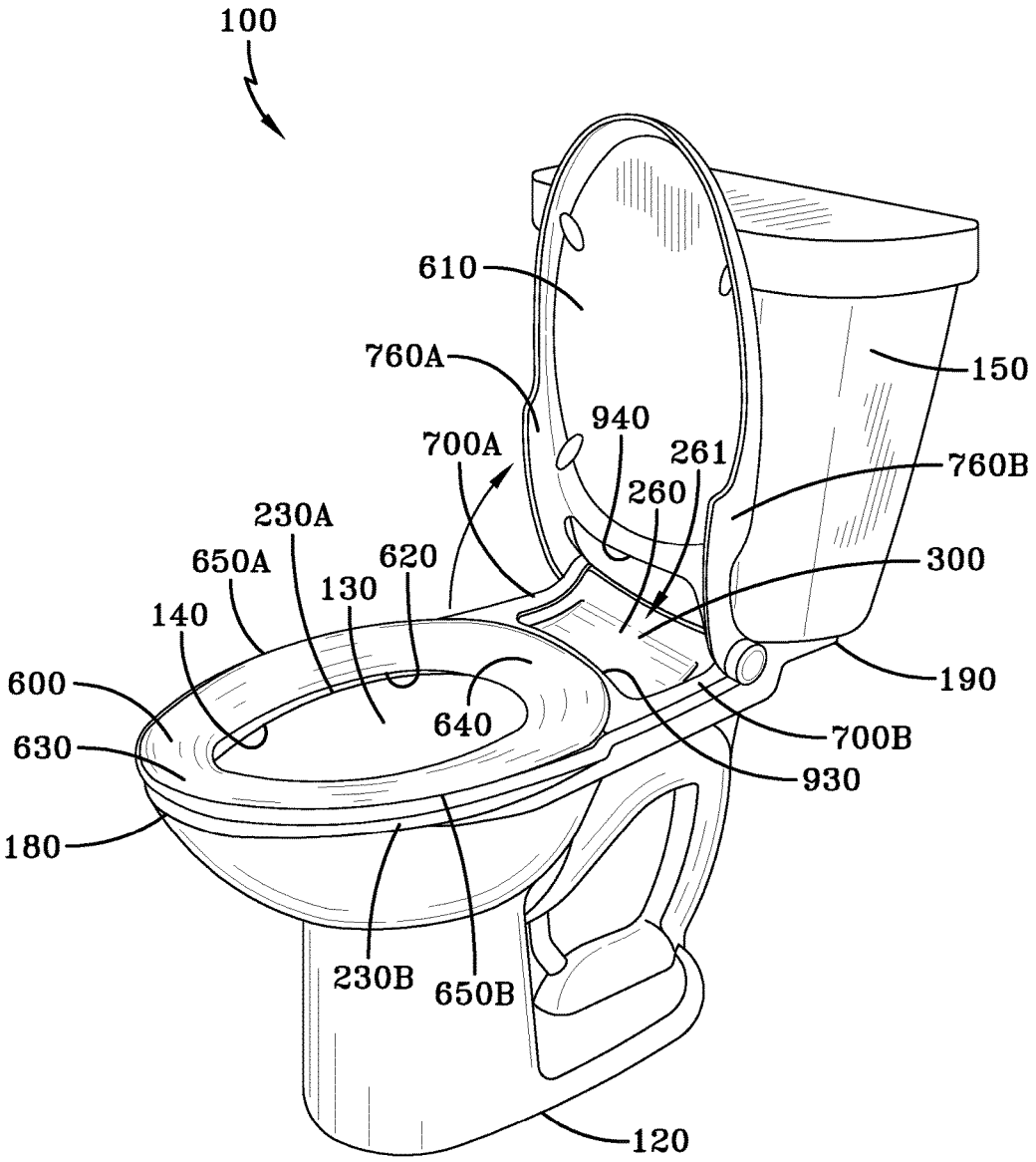
FIG. 2B is a perspective view of the toilet, whereby the toilet lid is in an opened position and a seat is resting upon an upper deck surface of a toilet base in accordance with the concepts of the present invention.

A toilet in accordance with the concepts of the present invention is generally referred to by numeral 100, as shown in FIGS. 2A-B. The toilet 100 includes a toilet base 120 having a bowl 130 and a corresponding bowl opening 140. The bowl 130 selectively receives flushwater from a tank 150 to remove debris within the bowl 130 through a primary outlet (not shown) disposed in the bottom thereof into a suitable sewer connection when a flushwater valve is actuated by an actuator 160, such as a lever (shown in FIG. 5).

Figure 3:
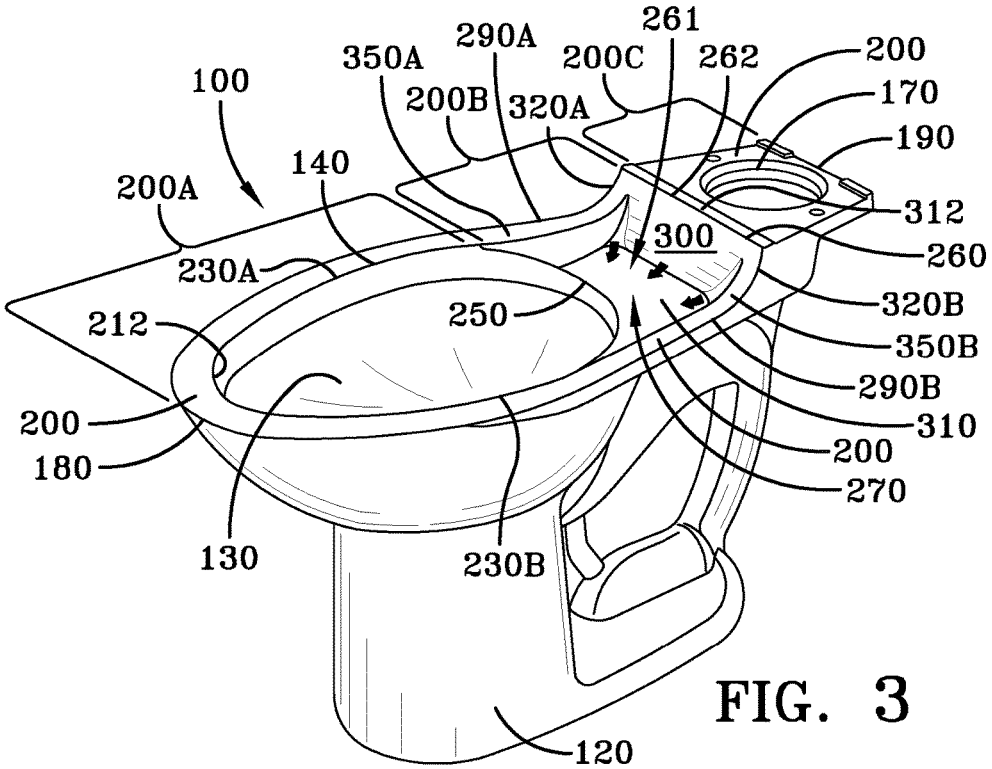
FIG. 3 is a perspective view of the toilet base that includes a drain surface in accordance with the concepts of the present invention.

The bowl opening 140, shown clearly in FIG. 3, is substantially circular, but may be any suitable shape. Positioned behind the bowl opening 140 is a flushwater inlet 170, which is configured to be fluidly coupled to a tank outlet 172, shown in FIGS. 11 and 12, that is provided by the tank 150 in order to receive flushwater therefrom. Disposed on the uppermost surface of the toilet base 120 is a deck surface 200, which circumscribes or surrounds the toilet bowl opening 140 and extends from a front end 180 of the toilet base 120 to a rear end 190 of the toilet base 120. In particular, with reference to FIG. 3, the deck surface 200 includes a forward deck portion 200A that partially circumscribes the periphery of the bowl opening 140, such that the forward deck portion 200A extends about a front edge 212 of the bowl opening 140 that is proximate to the front end 180 of the toilet base 120, and that extends around the lateral sides 230A-B of the bowl opening 140 to a point that is proximate to a rear edge 250 of the bowl opening 140, which is proximate to the rear end 190 of the toilet base 120. In other words, the forward deck portion 200A only extends from the front and lateral edges 212, 230A-B of the bowl opening and does not extend from the rear edge 250 of the bowl opening 140. An intermediate deck portion 200B extends between the forward deck portion 200A at a point proximate to the rear edge 250 of the bowl opening 140 to a rear edge or position 260 that is proximate to the front of the flushwater inlet 170, which is proximate to the front end 180 of the toilet base 120. In some embodiments, the edge or position 260 may be provided as a rear edge of a drain surface 261, as shown in FIG. 3, or may be located at any position between the rear edge 250 of the bowl opening 140 and the flushwater inlet 170. Finally, extending from the edge or position 260 to the rear end 190 of the toilet base 120 is a rear deck portion 200C. Thus, the deck surface 200 includes three portions or regions, the forward deck portion 200A, the intermediate deck portion 200B, and the rear deck portion 200C. In some embodiments, the deck portions 200A-C may be substantially flat so as to be substantially parallel to a support surface upon which the toilet base 120 rests. However, it should be appreciated that the deck portions 200A-C may take on any suitable shape, dimension or orientation.

Thus, as shown in FIG. 3, the rear deck portion 200C, which includes the flushwater inlet 170, is disposed in a plane that is higher than that of the intermediate deck portion 200B and the forward deck portion 200A. In other embodiments, one or more of the rear deck portion 200C, the intermediate deck portion 200B, and the forward deck portion 200A may be disposed in different planes at different vertical elevations or heights from one another; may be disposed in the same plane at substantially the same vertical elevation or height; or any combination thereof.

Figure 4:
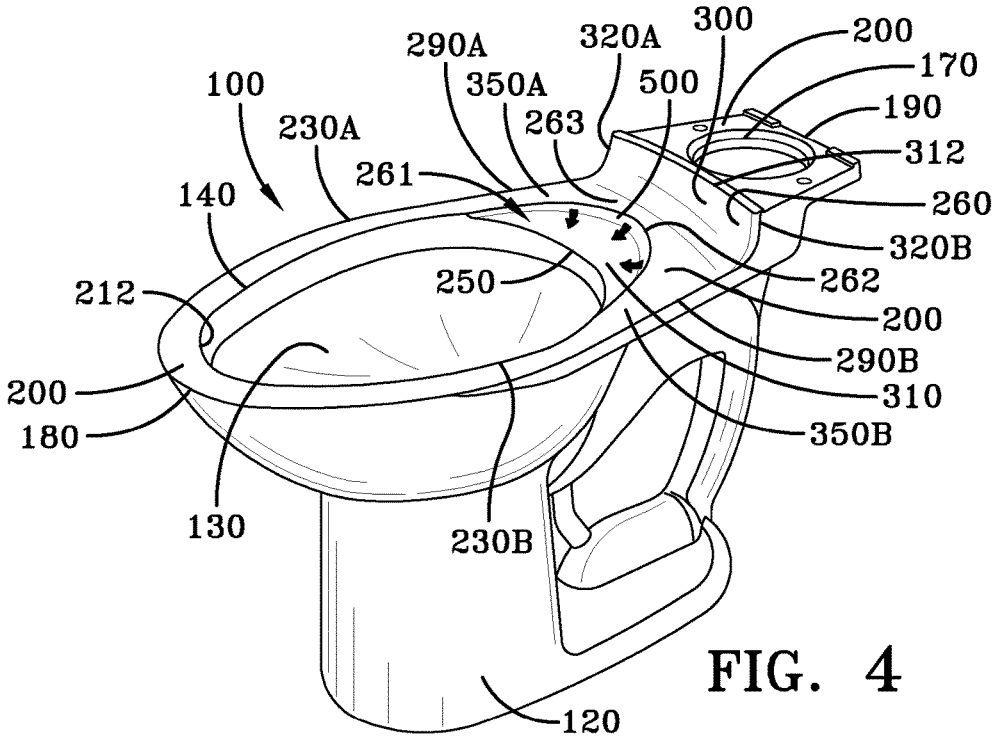
FIG. 4 is a perspective view of an alternate embodiment of the drain surface provided by the toilet, which includes a curved rear wall in accordance with the concepts of the present invention.
Figure 5:
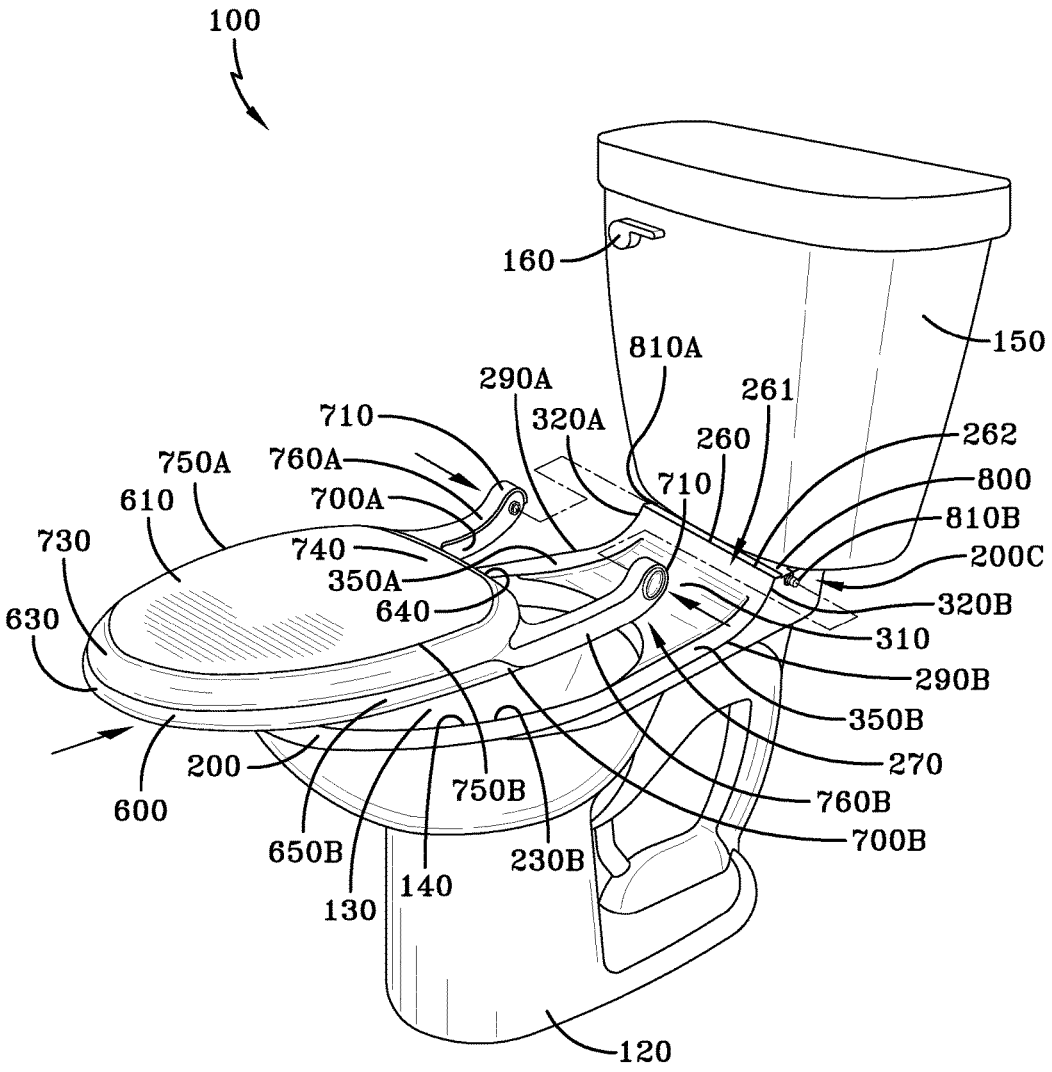
FIG. 5 is a perspective view of the toilet showing the manner in which the toilet seat and lid are attached to a pivot member in accordance with the concepts of the present invention.

Continuing, the intermediate deck portion 200B is bounded by lateral edges 290A-B, of the base 120. In addition, the drain surface 261, which is disposed between the lateral edges 290A-B, has an outer base surface 310 that extends from the rear edge 250 of the toilet bowl opening 140 to the rear edge 260 of the intermediate section 200B. In addition, the drain surface 261 may be configured so that the base surface 310 is curved, angled or contoured, as shown in FIGS. 4 and 5, so as to slope downward from a rear edge 262 that is proximate to, or coincident with, the rear edge 261 the intermediate section 200B to the rear edge 250 of the toilet bowl opening 140, so as to route the flow of liquid waste captured on the drain surface 261 toward, and ultimately into the toilet bowl opening 140. In other embodiments, the drain surface 261 may take on any suitable shape, slope, or angle. In still other embodiments, the sloped drain surface 261 may be disposed below an upper deck surface 263 of the intermediate portion 200B, as shown in FIG. 4.

In other embodiments, as shown in FIG. 3, the drain surface 261 may include a wall or backsplash 300 that extends at a substantially right angle from the base surface 310 or upper deck surface 263. In some embodiments, the wall 300 may extend to an upper edge 312 of the rear deck portion 200C that is coincident with the rear edge 261 of the intermediate portion 200B. However, it should be appreciated that the wall 300 may extend from the base surface 310 or upper deck surface 263 at any desired angle and to any desired height. Extending from the base surface 310 or upper deck surface 263 at a point proximate to each lateral edge 320A and 320B of the wall 300, at a substantially right angle, are respective side splash walls 350A and 350B. The side splash walls 350A-B are spaced apart, and in some embodiments are proximate to respective lateral edges 290A-B of the intermediate deck portion 200B. Thus, in some embodiments, the drain surface 261, the wall 300 and side splash walls 350A-B may be used together in any desired combination. For example, in some embodiments the intermediate deck portion 200B may not include the wall 300. In still other embodiments, the wall or backsplash 300, the side walls 350A-B, and any combination thereof, may interface with the base surface 310 of the drain surface 261 in a curved, contoured or rectilinear manner, so that they together slope or angle downward toward the toilet bowl opening 140, so as to route the flow of liquid waste, such as urine, captured thereby toward, and ultimately, into the toilet bowl opening 140. In one embodiment, the wall 300 and the side splash walls 350A-B may together form an integrated or continuous wall or surface that is curved, contoured, rectilinear or a combination thereof.

The toilet 10 may also include a toilet seat 600 and a toilet lid or cover 610 that are pivotably attached to the toilet base 120, such as to the rear deck portion 200C, as shown in FIGS. 2A-B, 5 and 7. Specifically, the seat 600 includes a seat opening 620, which substantially conforms or aligns to that of the bowl opening 140. The seat 600 includes a front portion 630 that is configured to be positioned proximate to the front edge 212 of the bowl opening 140, and a rear portion 640 that is configured to be positioned proximate to the rear edge 250 of the bowl opening 140 when the seat 600 is positioned to rest upon the deck surface 200. The toilet seat 600 also includes lateral edges 650A-B, which are positioned proximate to lateral edges 230A-B of the toilet bowl opening 140 when the seat 600 is positioned to rest upon the forward deck portion 200A. Extending away from the rear portion 640 of the seat 600 proximate to the lateral edges 650A-B are respective spaced, elongated attachment arms 700A-B, which terminate at respective ends 710A-B. It is also contemplated that in some embodiments, the arms 700A-B may extend from the lateralmost portion of the lateral edges 650A-B of the seat 600. It should be appreciated that the term "lateralmost", as used herein, is defined as the most lateral edge or region, or widest portion, of the structure being referred to.

In addition, the toilet lid 610 forms a cover for the seat opening 620 and the toilet bowl opening 140, and is configured to rest upon the toilet seat 600 when the lid 610 is brought to a substantially horizontal position proximate to the deck surface 200. The lid 610 includes a front portion 730 that is configured to be positioned proximate to the front edge 212 of the bowl opening 140, and a rear portion 740 that is configured to be positioned proximate to the rear edge 250 of the bowl opening 140, when the lid 610 is positioned to rest upon the seat 600, as shown in FIG. 5. The toilet lid 610 also includes lateral edges 750A-B, which are positioned proximate to lateral edges 230A-B of the toilet bowl opening 140 when the lid 610 is positioned to rest upon the toilet seat 600. The toilet lid 610 also includes a pair of spaced, elongated attachment arms 760A-B, which extend away the rear portion 740 of the lid 610 proximate to respective lateral edges 750A-B, which terminate at respective ends 780A-B. It is also contemplated that in some embodiments, the arms 760A-B may extend away from the lateralmost portion of the lateral edges 750A-B of the toilet lid 610.

In one embodiment, the respective terminal ends 710A-B and 780A-B of the attachment arms 700A-B and 760A-B of the toilet seat 600 and toilet lid 610 are configured to be pivotably attached to the rear deck portion 200C using any suitable pivoting mechanism. However, it should be appreciated that in other embodiments, that the ends 710A-B and 780A-B of the respective arms 700A-B and 760A-B may be pivotably attached to any suitable portion of the toilet base 120, including any of the portions 200A-C of the deck surface 200. For example, the ends 710A-B and 780A-B of the respective attachment arms 700A-B and 760A-B may be attached to the intermediate portion 200B of the toilet base 120 using any suitable means of attachment. In other words, the axis about the attachment arms 700A-B and 7A-B pivot may be located at any desired point relative to the toilet base 120.

Figure 8:
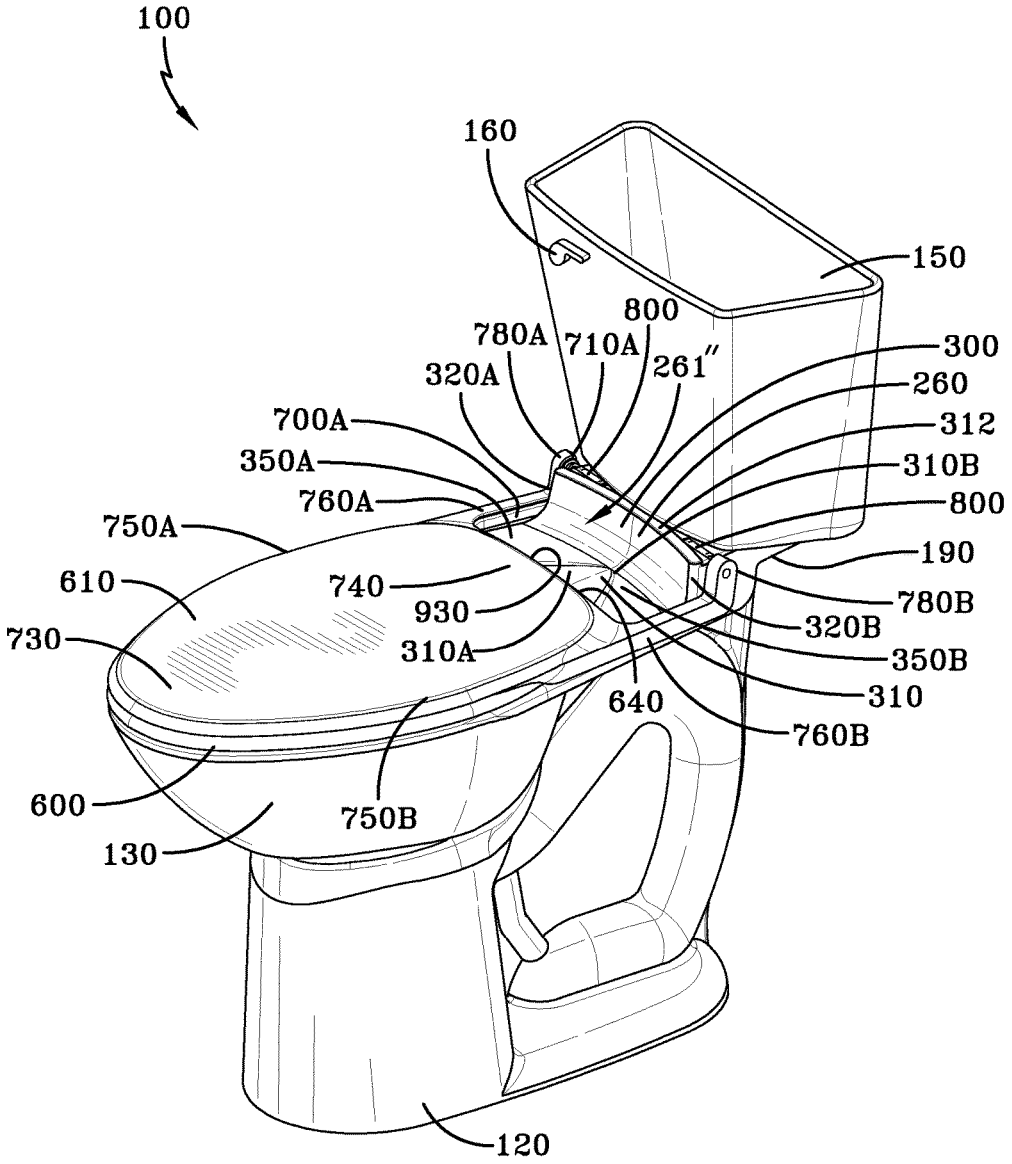
FIG. 8 is a perspective view of a toilet including an alternative drain surface in accordance with the concepts of the present invention.

Thus, the toilet seat 600 and toilet lid 610 are configured so that when they are brought to rest upon, or moved proximate to, the deck surface 200, the attachment arms 700A-B and 760A-B thereof are positioned laterally and to the outside of at least a portion of the intermediate deck portion 200B, and/or the rear deck portion 200C. Such position of the elongated attachment arms 700A-B and 760A-B allows the deck surface 200 to be free of obstructions when the toilet seat 600 and toilet lid 610 are raised to a substantially vertical position, so as to be proximate to the tank 150. Furthermore, in some embodiments, the arms 700A-B and 760A-B are dimensioned so that the rear edge 640 of the toilet seat 600 and the rear edge 740 of the toilet lid 610 are spaced away from the wall 300 of the drain surface 261 to form respective openings 930 and 940 relative to the seat 600 and lid 610, as shown in the Figs. As such, when the toilet seat 600 and toilet lid 610 are moved to a substantially horizontal position to rest upon the deck surface 200, as shown in FIGS. 2A and 8, the arms 700A-B and 710A-B form respective openings 930 and 940, which allow direct access to the drain surface 261 for cleaning purposes.

In one embodiment, the attachment arms 700A-B and 760A-B may pivot on an axis that is located between the rear edge 250 of the bowl opening 140 and the flushwater inlet or opening 170. In addition, in some embodiments, the axis about the attachment arms 700A-B and 760A-B pivot is located at the rear deck portion 200C, so as to be proximate to the flushwater inlet 170. In other embodiments, the axis about which the attachment arms 700A-B and 760A-B pivot is proximate to the flushwater inlet 170 that is provided at the rear deck portion 200C, which is also disposed on a plane positioned vertically above the intermediate deck portion 200B. It should also be appreciated that in other embodiments of the toilet seat and lid 600,610, the axis about which the attachment arms 700A-B and 760A-B pivot may be positioned at any other location relative to the toilet base 120, including between the flushwater inlet 170 and the rear end 190 of the toilet base 120. It should also be appreciated that the pivot axis of any of the embodiments disclosed herein may be oriented so as to be substantially perpendicular to the longitudinal axis of the toilet base 120, which extends from the front end 180 to the rear end 190 of the toilet base 120.

Figure 6:
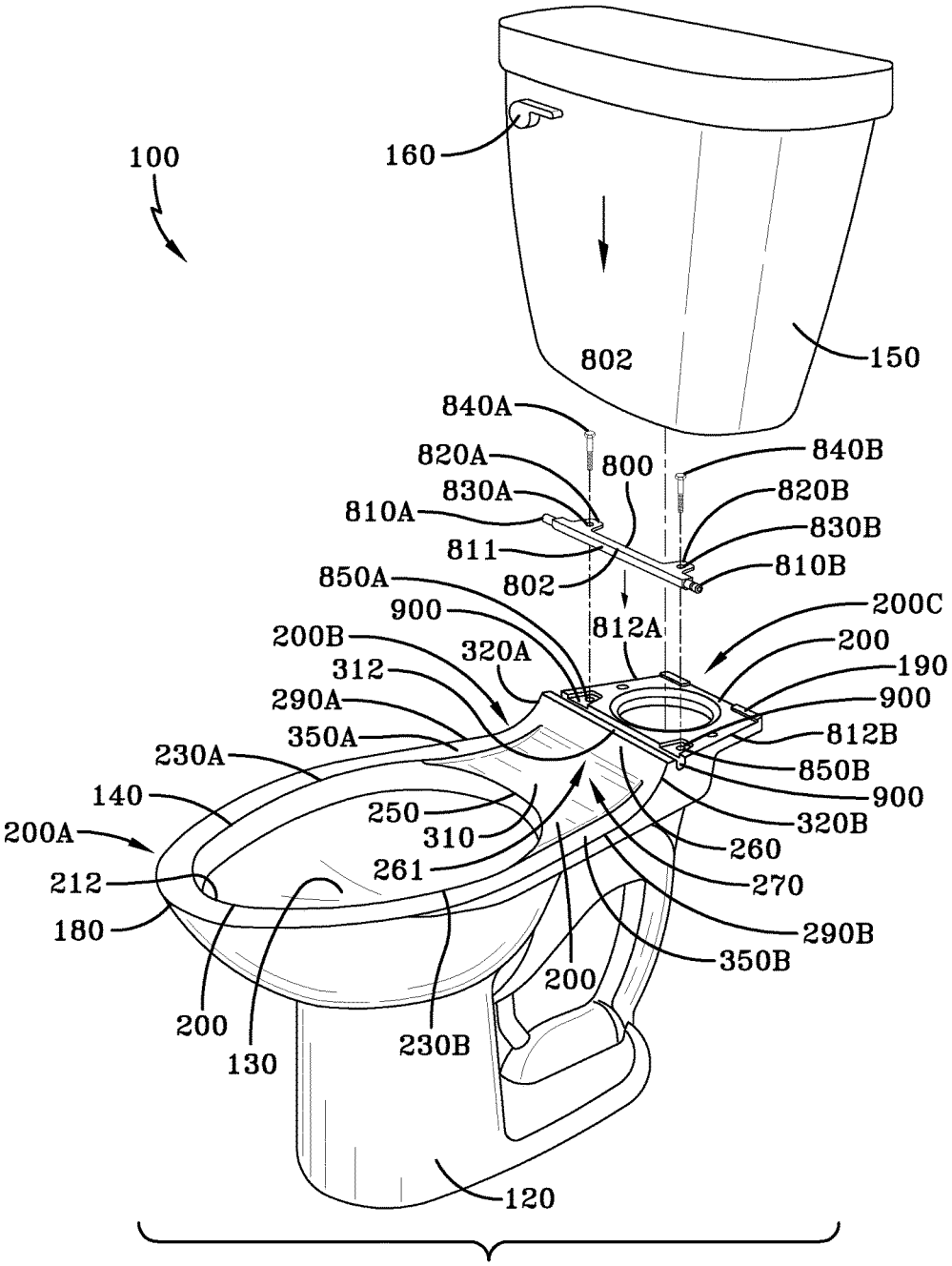
FIG. 6 is a perspective view of the toilet showing the attachment of the pivot member to the toilet in accordance with the concepts of the present invention.
Figure 7:
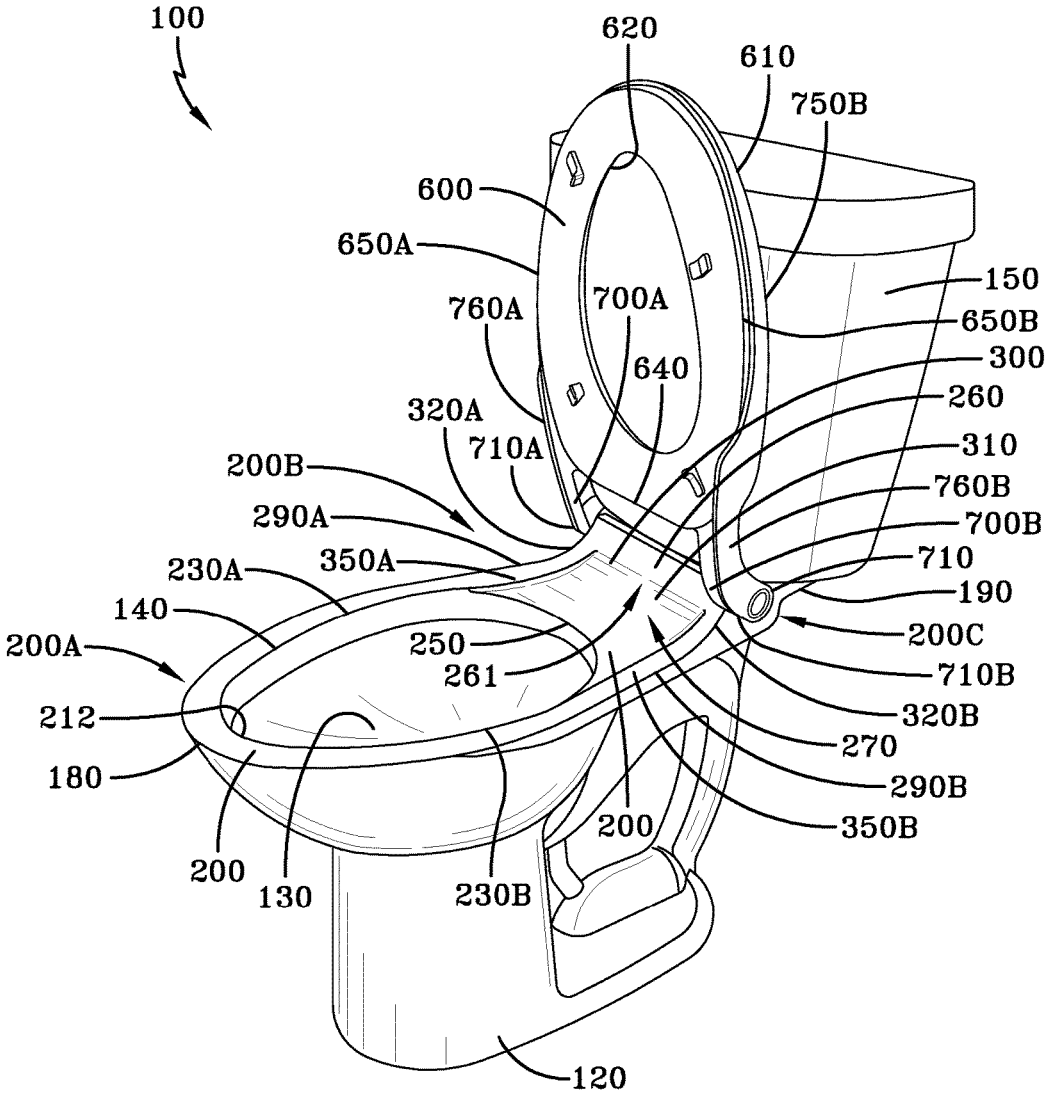
FIG. 7 is a perspective view of the toilet showing the manner in which the drain surface is left clear and unobstructed when the seat and lid are raised to a substantially vertical position.

In another embodiment, the toilet seat 600 and toilet lid 610 are pivotably attached to the toilet base 120 by a pivot member 800 that is secured to the rear deck portion 200C and positioned proximate to the flushwater inlet 170, as shown in FIGS. 5-7. The pivot member 800, shown clearly in FIG. 6, comprises an elongated section or body 802, such as an elongated bar or tube, which may be formed of any suitable material, such as metal or plastic, that is terminated at opposed ends 810A-B. Extending from an outer surface 811 of the pivot member body 802 are mounting bosses 820A-B, which include respective apertures 830A-B for attaching the pivot member 800 to the toilet base 120 via suitable fasteners 840A-B, such as a screws threadably received within corresponding apertures 850A-B in the rear deck portion 200C of the toilet base 120. In one embodiment, the pivot member 800 may be disposed within a corresponding or complementary recess 900 provided in the deck surface 200 of the rear deck portion 200C. The ends 810A-B of the pivot member 800 are configured to pivotably attach to respective terminal ends 710A-B of the arms 700A-B of the seat 600 and to respective terminal ends 780A-B of the arms 760-B of the lid 610, as shown in FIG. 5. Once the pivot member 800 is attached to the rear deck portion 200C, the pivot member 800 is dimensioned so that the ends 810A-B extend beyond the lateralmost portion of the rear deck portion 200C. Alternatively, the ends 810A-B of the pivot member 800 may also extend beyond both the lateral edges 812A-B of the rear deck portion 200C and the lateral edges 290A-B of the intermediate deck portion 200B, which in some embodiments may be defined by the lateral edges 320A-B of the wall 300.

Thus, the arms 700A-B of the seat 600 and the arms 760A-B of the lid 610 respectively extend from a position proximate to the lateral edges 650A-B of the seat 600 and from a position proximate to the lateral edges 750A-B of the lid 610, and attach to pivot ends 810A-B that extend beyond the lateralmost portion of the edges 320A-B of the intermediate deck portion 200B. It should be appreciated that in some embodiments, the arms 700A-B of the seat 600 and the arms 760A-B of the lid 610 may extend from the lateralmost portion of respective lateral edges 650A-B and 750A-B, or alternatively the arms 700A-B and 760A-B may extend from the seat 600 and lid 610 at any suitable position and at any suitable angle or orientation. In addition, the arms 700A-B and 760A-B are spaced apart so that they are positioned outside or beyond the lateral edges 290A-B of the deck surface 200, or a portion thereof. As a result of the spacing of the arms 700A-B and 760A-B, and the dimensions of the pivot member 800, when the toilet seat 600 and lid 610 are moved to a substantially vertical position, so as to be proximate to the tank 150, as shown in FIG. 7, the intermediate deck portion 200B is left clear and unobstructed, and can be easily accessed for cleaning purposes, which is highly desirable. It should also be appreciated that in other embodiments that only one arm 700 and 760 may be used by the respective seat 600 and lid 610.

In still other embodiments, the toilet seat and lid 600,610 may include manually actuated quick release mechanisms, which allow the toilet seat and/or lid 600,610 to be readily removed from the pivot member 800 and re-attached to the pivot bar 800, as shown in FIG. 5.

Figure 9:
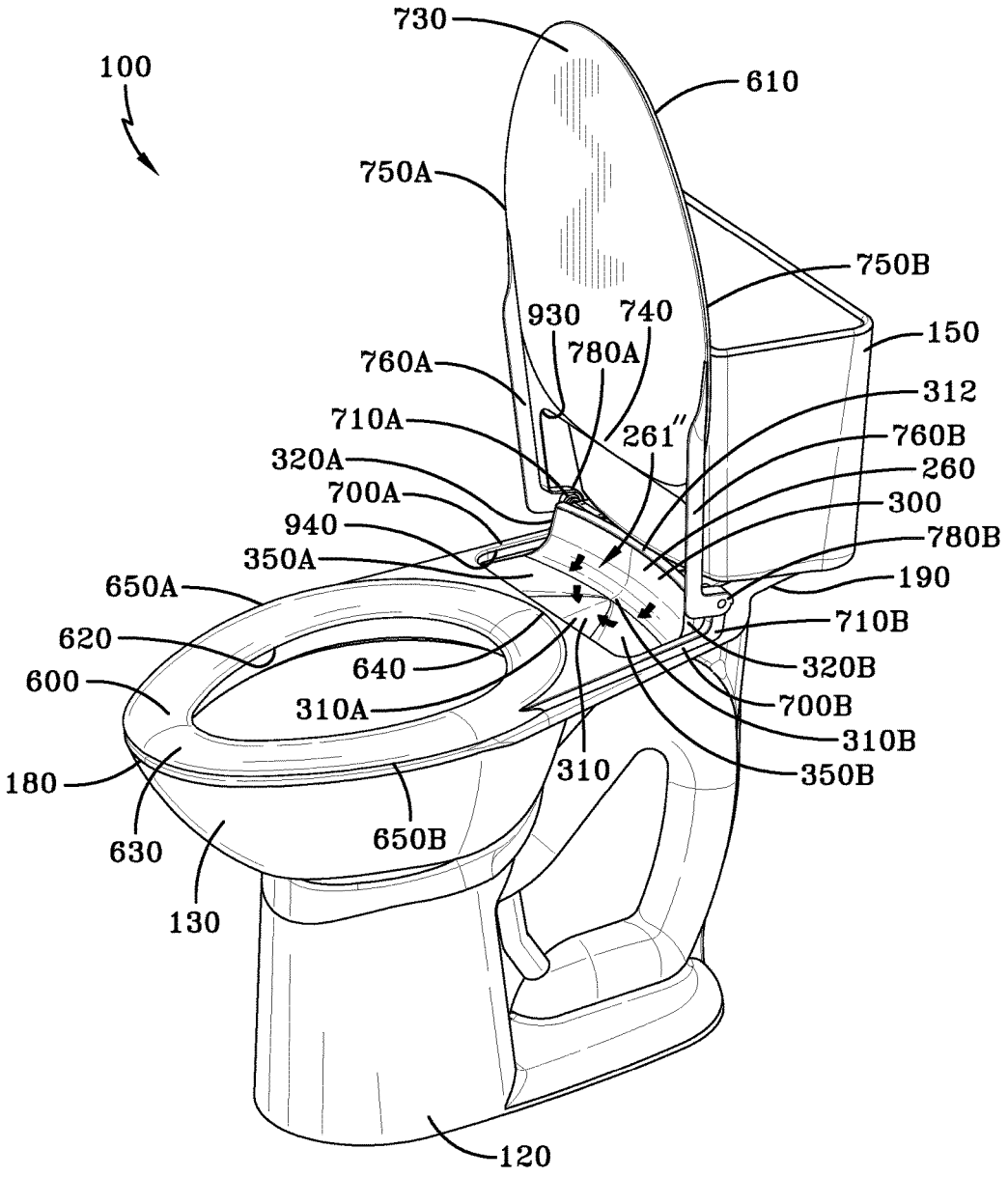
FIG. 9 is another perspective view of the toilet including the alternative backsplash in accordance with the concepts of the present invention.
Figure 10:
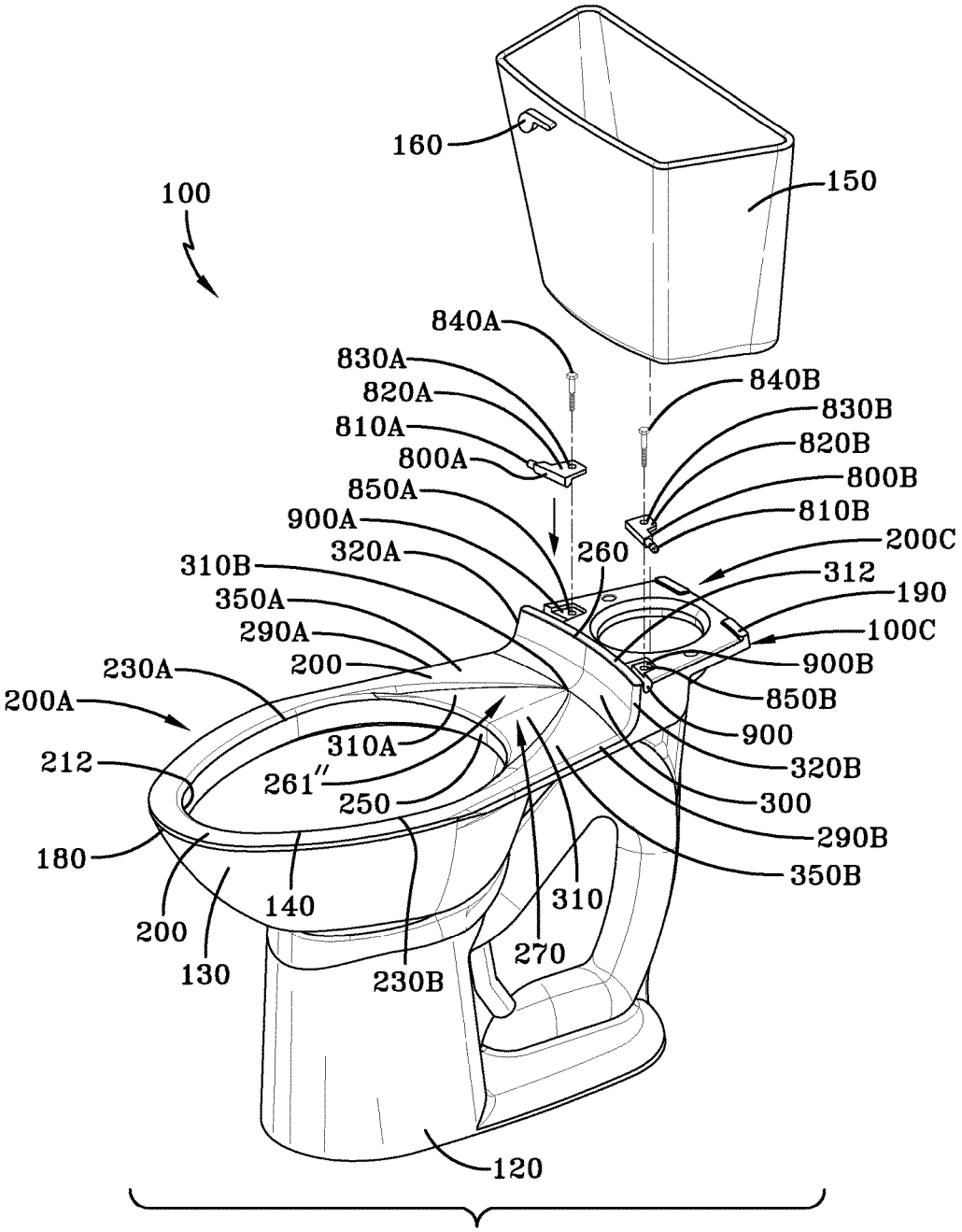
FIG. 10 is a further perspective view of the toilet including the alternative drain surface showing the manner of attachment of the pivot members used to rotatably carry the toilet seat and lid in accordance with the concepts of the present invention.

In another embodiment, as shown in FIGS. 8-10, the toilet 100 may include an alternative drain surface 261", whereby the base surface 310 includes an angled or tapered section 310A that gradually slopes downward from an apex 310B positioned proximate to the rear wall 300 into the rear edge 250 of the bowl opening 140. The angled or tapered base section 310A is bounded by the side splash walls 350A-B, which extend from the apex 310B at an oblique angle from the rear splash wall 260. In addition, the tapered section 310A may be sloped downward to the rear edge 250 of the bowl opening 140 to facilitate the drainage of liquid waste, such as urine, that is captured in the tapered base surface 310A during the use of the toilet 100.

Additionally, in other embodiments, the pivot member 800 may be formed in two pieces or sections, designated as 800A and 800B, as shown in FIG. 10. The pivot member sections 800A-B, each include a body, such as an elongated bar or tube, which may be formed of any suitable material, such as metal or plastic. Each pivot member 800A-B includes an end 810A-B that is configured to be pivotably attached to the seat 600 and lid 610. The pivot members 800A-B also include mounting bosses 820A-B, which include respective apertures 830A-B for attaching the pivot member 800 to the toilet base 120 via suitable fasteners 840A-B, such as a screws threadably received within corresponding apertures 850A-B in the rear deck portion 200C of the toilet base 120. In one embodiment, the pivot members 800A-B may each be disposed within respective, corresponding or complementary recesses 900A-B that are provided in the deck surface 200 of the rear deck portion 200C. The ends 810A-B of the pivot members 800A-B are configured to pivotably attach to respective terminal ends 710A-B of the arms 700A-B of the seat 600 and to respective terminal ends 780A-B of the arms 760-B of the lid 610, as shown in FIGS. 8-9.

Figure 11:
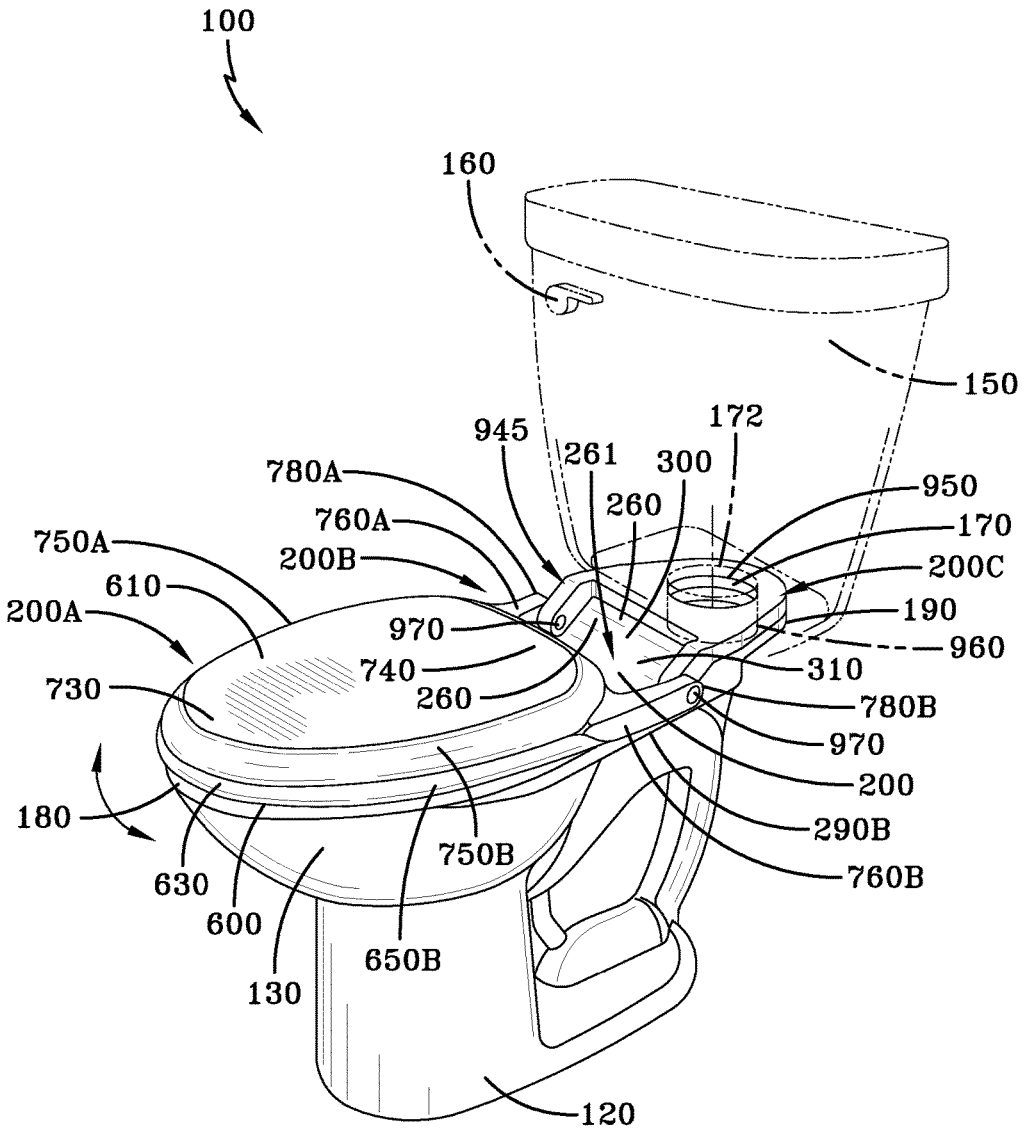
FIG. 11 is a perspective view of a further embodiment of the toilet including a pivot arm that is configured to rotatably carry the toilet seat and lid laterally, to the side in accordance with the concepts of the present invention.
Figure 12:
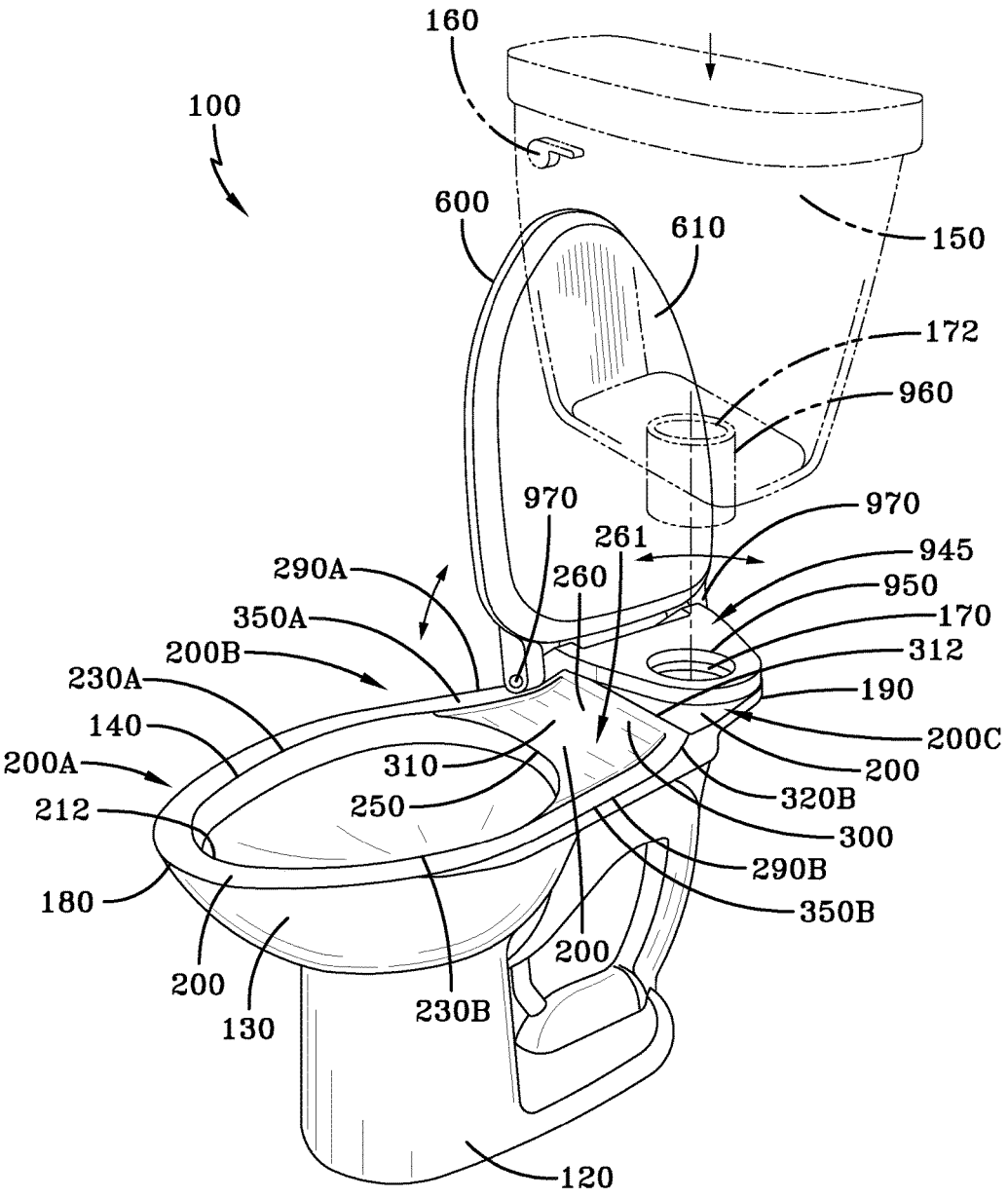
FIG. 12 is another perspective view of the further embodiment of the toilet of FIG. 11 showing the toilet seat and lid fully rotated laterally, to the side to allow clear, unobstructed access to the drain surface in accordance with the concepts of the present invention.

In an alternative environment, as shown in FIGS. 11 and 12, the seat 600 and lid 610 may be attached to the toilet 100 by an attachment member 945, that includes an annular mounting aperture 950. In addition, the ends 710A-B and 780A-B of the arms 700A-B and 760A-B of the respective seat 600 and lid 610 are each pivtoably attached to the attachment member 945 by one or more hinges 970 or any other suitable device. The mounting aperture 950 of the attachment member 945 is configured to rotatably receive therein a cylindrical mounting collar or tube 960 that extends from the flushwater outlet 172 of the tank 150. It should be appreciated that in some embodiments, the arms 700A-B and 760A-B of the respective seat 600 and lid 610 attach to the hinges 970 so that they are outside or beyond the lateralmost portion of the lateral edges 290A-B of the intermediate deck portion 200B, and/or the end deck portion 200C, or portion thereof, as previously discussed. As such, the mounting aperture 950 is permitted to freely rotate or pivot about the mounting collar 960, which forms a substantially vertically oriented pivot axis, so as to allow the toilet seat 600 and toilet lid 610 to be rotated together, laterally to the side, away from the toilet bowl 130, as shown in FIG. 12. This allows, the forward deck portion 200A and the intermediate deck portion 200B of the toilet 100 is left clear and unobstructed so that they can be easily accessed and cleaned. It should be appreciated that in other embodiments, the attachment member 945 may comprise a pair of rotating attachment members, so as to be configured to allow the seat 600 and lid 610 to each rotate independently.

Therefore, one advantage of the present invention is that a toilet with enhanced cleaning features provides a seat and lid, which include attachment arms that are positioned outside of or beyond the lateralmost edge of an intermediate portion of a deck surface to allow direct, unobstructed access to the backsplash when the seat and lid are raised to a substantially vertical position to facilitate the cleaning of the backsplash. Still another advantage of the present invention is that a toilet with enhanced cleaning features includes a seat and lid that are pivotable attached to the to the toilet base, such that the pivot axis is positioned proximate to the flushwater inlet. Yet another one advantage of the present invention is that a toilet with enhanced cleaning features includes a sloped surface or backsplash that is positioned behind a toilet bowl opening to facilitate the drainage of liquid waste, such as urine, captured in the backsplash back into the toilet bowl.

Thus, it can be seen that the objects of the present invention have been satisfied by the structure and its method for use presented above. While in accordance with the Patent Statutes, only the best mode and preferred embodiments have been presented and described in detail, with it being understood that the present invention is not limited thereto or thereby. Accordingly, for an appreciation of the true scope and breadth of the invention, reference should be made to the following claims.

What is claimed is:

1. A toilet comprising:

a base having an opening that extends into a bowl, wherein said base includes a deck surface that extends outward from an edge of said opening;

a flushwater inlet disposed in said deck surface, which is adapted to receive flushwater therein for delivery to said bowl; and an accessory adapted to be pivotably attached to said base, said accessory pivoting on an axis that is proximate to said flushwater inlet.

2. The toilet of claim 1, wherein said axis is positioned closer to said flushwater inlet than to said opening of said bowl.

3. The toilet of claim 1, wherein a first portion of said deck surface proximate to said flushwater inlet is elevated above a second portion of the deck surface that is proximate to said bowl opening, and wherein said axis is positioned at said first portion.

4. The toilet of claim 3, wherein said first portion includes at least one recess to receive therein a pivot member, wherein said accessory is pivotably attached to said pivot member.

5. The toilet of claim 4, wherein said pivot member is attached to said base by a fastener.

6. The toilet of claim 1, wherein said accessory comprises a toilet seat.

7. The toilet of claim 6, wherein said accessory further comprises a toilet lid.

8. The toilet of claim 1, wherein said accessory is pivotably attached to said base by at least one elongated arm that extends from said accessory.

9. A toilet comprising:

a base having an opening that extends into a bowl, wherein said base includes a deck surface that extends outward from an edge of said opening;

a flushwater inlet disposed in said deck surface, which is adapted to receive flushwater therein for delivery to said bowl; and an accessory having at least one elongated arm that extends therefrom that is adapted to be pivotably attached to said base, such that when said accessory is moved to be proximate to said deck surface, said at least one arm is positioned laterally, and to the outside, of at least a portion of said deck surface that is positioned between said opening of said bowl and said flushwater inlet.

10. The toilet of claim 9, wherein said at least one elongated arm comprises a first arm and a second arm, such that when said accessory is moved to be proximate to said deck surface, said first arm is positioned proximate to one part of said deck surface and said second arm is positioned proximate to another part of said deck surface.

11. The toilet of claim 9, wherein said accessory comprises a toilet seat.

12. The toilet of claim 11, wherein said accessory further comprises a toilet lid.

13. A toilet comprising:

a base having an opening that extends into a bowl, wherein said base includes a deck surface that extends outward from an edge of said opening;

a flushwater inlet disposed in said deck surface, which is adapted to receive flushwater therein for delivery to said bowl; and an attachment member pivotably attached to said base, said attachment member pivoting about a substantially vertical axis, wherein said attachment member is adapted to be attached to an accessory.

14. The toilet of claim 13, wherein said accessory comprises a toilet seat.

15. The toilet of claim 14, wherein said accessory further comprises a toilet lid.

16. The toilet of claim 14, wherein said attachment member includes an elongated arm extending therefrom that is adapted to be attached to the accessory.

17. The toilet of claim 13, wherein said attachment member pivots around said flushwater inlet.

18. A toilet comprising:

a base having an opening that extends into a bowl, wherein said base includes a deck surface that extends outward from an edge of said opening; and a flushwater inlet disposed in said deck surface, which is adapted to receive flushwater therein for delivery to said bowl, wherein at least a portion of said deck surface that is positioned between said opening of said bowl and said flushwater inlet includes a drain surface that is sloped downward toward said edge of said opening of said bowl.

19. The toilet of claim 18, further comprising an accessory that is pivotably attached to said base at a position between said drain surface and said flushwater inlet.

20. The toilet of claim 19, wherein said accessory comprises a toilet seat.

21. The toilet of claim 20, wherein said accessory further comprises a toilet lid.

22. The toilet of claim 18, wherein said drain surface includes a substantially vertically extending wall.

23. The toilet of claim 22, wherein said wall is positioned substantially opposite to a rear edge of said opening of said bowl.

24. The toilet of claim 18, wherein said drain surface is sloped downward toward a longitudinal axis of the toilet, which extends through said opening of said bowl and said flushwater inlet.

* * * * *